United States Patent [19]

Echazabal, Jr.

[11] Patent Number: 4,650,100

[45] Date of Patent: Mar. 17, 1987

[54] DISPOSABLE DISPENSING CONTAINER

[76] Inventor: Julio Echazabal, Jr., 491 NW. 59 Ave., Miami, Fla. 33126

[21] Appl. No.: 723,378

[22] Filed: Apr. 15, 1985

[51] Int. Cl.[4] ..... A47G 19/14

[52] U.S. Cl. ..... 222/475; 222/530; D9/374

[58] Field of Search ..... 222/465 R, 475, 538, 222/530, 527, 529; D9/374, 378, 447

[56] References Cited

U.S. PATENT DOCUMENTS

| | | | |
|---|---|---|---|
| 1,838,468 | 12/1931 | Thomson | 222/475 |
| 1,869,869 | 8/1932 | Smith | 222/475 |
| 2,516,728 | 7/1950 | Smith | 222/530 |
| 3,329,316 | 7/1967 | Lowe | 222/538 |
| 4,318,403 | 3/1982 | Sneider | 222/538 |
| 4,416,396 | 11/1983 | Ward | 222/530 |

*Primary Examiner*—H. Grant Skaggs

*Attorney, Agent, or Firm*—John Cyril Malloy

[57] ABSTRACT

A disposable packaging and dispensing container preferably formed from a plastic or like moldable material having a hollow interior portion for the storage of liquid material wherein the interior is defined by boundary walls including a base, front, rear, and opposite side walls and an integrally formed top covering panel as well as a gripping handle defining the top end of the container for lifting and handling thereof. The container is preferably formed from an integral, one-piece molded construction so as to be readily disposable after use. A dispensing spout is removably retained within a storage channel integrally formed in recessed relation about the exterior peripheral surface of the container in a non-obstructing location wherein the length of the spout is sufficient to allow dispensing of the liquid material from the interior of the container without tilting or angular orientation of the container.

5 Claims, 8 Drawing Figures

DISPOSABLE DISPENSING CONTAINER

BACKGROUND OF THE INVENTION

1. Field of the Invention

A container for packaging and dispensing a liquid material therefrom which is specifically structured to include an integral spout stored about the external periphery of the container in recessed relation to the exposed outer surface thereof wherein the overall configuration of the container and the out-of-the-way storage and retention of the spout facilitates storage and packing of a plurality of such containers as well as enabling dispensing of the liquid from the interior of the container without tilting, angular orientation or undue handling or lifting of the container during such dispensing process.

2. Description of the Prior Art

Containers primarily designed for the packaging of materials, including liquids, are known to come in a variety of structures, configurations and dimensions dependent on the particular material being dispensed as well as other considerations such as transporting and storage of one or more of such containers. Included in such prior art structures are containers specifically adapted to provide dispensing of liquid from the interior thereof to a specific location. Generally, more sophisticated structures of this type include some type of dispensing spout, nozzle, etc. wherein the packaged liquid (or other material) can be dispensed in a delivered fashion to a specific location rather than just accomplishing emptying of the container. Accordingly, this latter type of dispensing container structure differs from well known bottles, cans, etc. wherein a top, cover or lid is removed to accomplish emptying of the container.

Structures of the type mentioned above are represented in the U.S. Patents to Thomson, U.S. Pat. No. 1,838,468; Gangwisch, U.S. Pat. No. 4,171,075; Conn, U.S. Pat. No. 4,269,332; and Swett, U.S. Pat. No. 4,392,594. Of the above listed prior art structures, the patent to Swett is directed to a watering can wherein water, or any suitable liquid material, is maintained on the interior of the can or container and may be delivered or dispensed to a specific location through a conduit and dispensing nozzle communicating with the lower portion of the interior of the container. The conduit and nozzle are of apparent sufficient flexibility to move or position the nozzle relative to the container without movement or placement of the latter. Further, the conduit and nozzle itself is stored in substantially recessed or at least partially enclosed relation within one of two handle structures associated with the watering can apparently for the purposes of providing a more compact structure when the dispensing conduit and nozzle are not being utilized.

Therefore, the patent to Swett as well as the remaining structures disclosed in the above set forth patents recognize that while dispensing of liquid material to a specific location, through the utilization of a dispensing conduit and/or spout or nozzle type structure, is often desirable, a problem exists with the storage or maintenance of the dispensing conduit structure in an out-of-the-way location. This storage problem is particularly burdensome when considering a disposable container in which a liquid product is packaged for selling, transporting and dispensing. In order to have all of the above capabilities, a preferred dispensing container must incorporate a dispensing conduit, nozzle, spout, etc.

which can be stored totally in an unobstructing, out of the way location and particularly in non-protruding relation relative to the exposed surface of the container. Further, the structure associated with the storage of such a dispensing conduit should be of sufficient dimension and configuration to allow the overall longitudinal dimension of the storage conduit to be sufficient to allow specific dispensing of the liquid material at a point sufficiently remote from the placement or positioning of the container during the dispensing process. Also, the overall dimension and configuration of the container should be such as to allow a plurality of such containers to be packaged in side-by-side relation to one another and stacked on top of one another such as when placed in a large shipping box, crate or overall transporting container.

Accordingly, it is readily apparent that there is a need in the packaging industry for a disposable, dispensing container having the structural features as set forth above and which is specifically designed and configured to overcome the existing problem as outlined herein.

SUMMARY OF THE INVENTION

The present invention is directed towards a dispensing container, preferably formed from a plastic or like moldable material which may be flexible but also which has sufficient rigidity to be maintained in an upstanding orientation. The subject container is specifically structured and configured to provide storage of liquid material on the hollow interior thereof and serve as a packaging facility for the display and sale of the fluid product. In addition, the subject container includes a dispensing means in the form of an elongated dispensing conduit having one end fixedly or integrally attached to an access aperture formed adjacent a base means of the container at the lower end thereof. The access aperture is particularly placed to provide direct fluid communication between the hollow interior of the container and the liquid product maintained therein and the interior of the conduit. The opposite end of the dispensing conduit may have a cap or stopper attached thereto to prevent leakage but which is otherwise open to allow delivery and dispensing of the liquid through this opened end. Further, the overall length of the conduit is such as to allow dispensing or delivery of the contained liquid to one or more specified locations such as when filling a radiator of an automobile with an anti-freeze solution or cooling liquid.

In addition to the above, the subject container is specifically structured to eliminate the necessity of tilting or angularly orienting the container to accomplish emptying of the liquid product therefrom. To the contrary, the container may be placed on almost any type supporting surface and the dispensing conduit can be detached from a stored position on the container and extended until the open end thereof is properly positioned adjacent the location (radiator or the like) to which the contained liquid is intended to be delivered. In order to accomplish such desired dispensing capability, the length of the conduit must be sufficient for placement of the open end thereof at a location sufficiently remote from the supported position of the container as to provide the container with proper versatility in the dispensing of the liquid product therefrom.

While the length of the dispensing conduit must be sufficient to accomplish the above dispensing features, the container must be specifically structured to accommodate proper storage of the dispensing conduit when not in use such that the stored conduit will not interfere with the close positioning and/or stacking of a plurality of such containers in close proximity to one another such as when a large number of such containers are shipped by crate or the like.

The subject container therefor incorporates an integrally formed recessed storage channel extending about a major peripheral dimension of the container and in recessed relation to the outer or exposed surface of the container. Stacking or adjacent position of a plurality of such containers is thereby facilitated.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
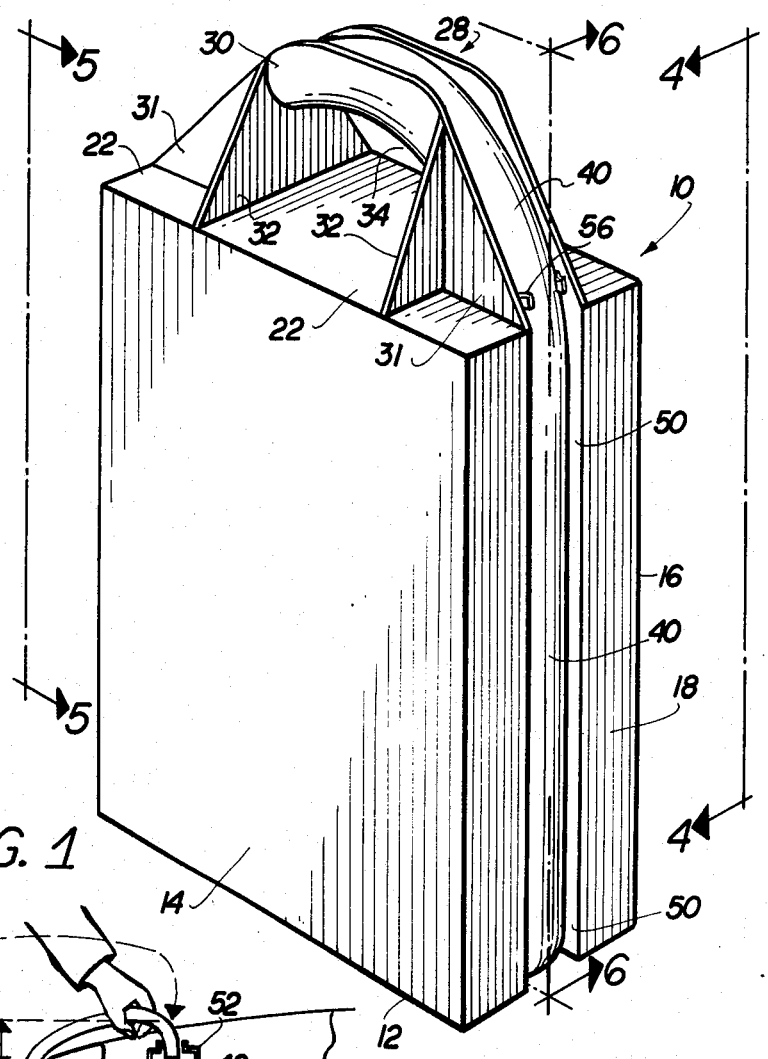
FIG. 1 is a perspective view of the container of the present invention.

The container of the present invention is generally indicated as 10 and comprises a base 12 and front and rear side walls 14 and 16 integrally secured to and extending upwardly from the base means 12. Similarly, opposite side walls 18 and 20 extend upwardly from base means 12 and are disposed in interconnecting relation between the front and rear walls 14 and 16 and in spaced relation to one another. A top panel 22 is integrally secured and disposed in interconnecting relation to the upper peripheral edges of the front, rear, and opposite side walls and in spaced apart relation at the other end of the container 10 relative to the base means 12. The walls and top panel collectively define the boundaries of a hollow interior portion 24 within the container 10, wherein such hollow interior portion 24 is specifically structured and configured to have a liquid product or material 26 maintained therein.

A handle means is generally indicated as 28 and includes a gripping portion 30 disposed in spaced apart and overlying relation to the top panel 22. Bracing flanges 32 are provided to strengthen and reinforce the gripping portion 30 and further serve to provide the boundaries of a hand space 34 located beneath the gripping portion 30 and immediately above the top panel 22. Such hand space 34 is specifically dimensioned to allow passage therethrough of a person's hand to hold, carry and position the container 10 as clearly shown in FIG. 2. The gripping portion 30 has its opposite ends as at 31 integrally affixed and oriented in upstanding relation to the top panel 22 as shown clearly in FIGS. 1, 4 and 5.

Figure 2:
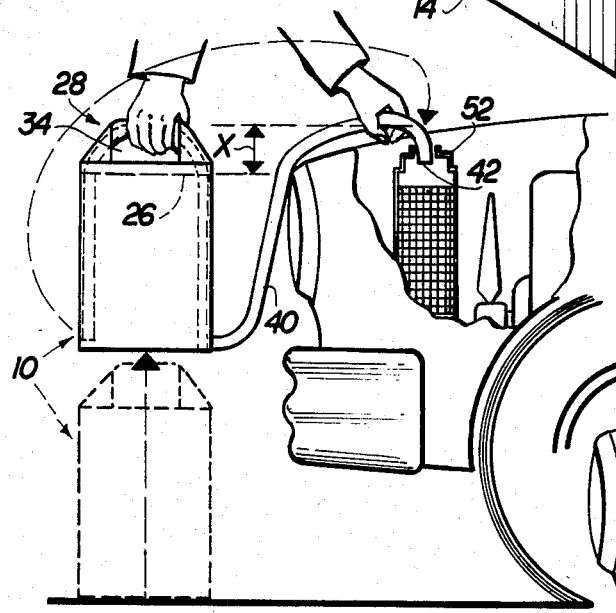
FIG. 2 is a front plan view of the container during the dispensing of a liquid product therefrom. The container is shown in its stored non-dispensing position to broken lines.
Figure 3:
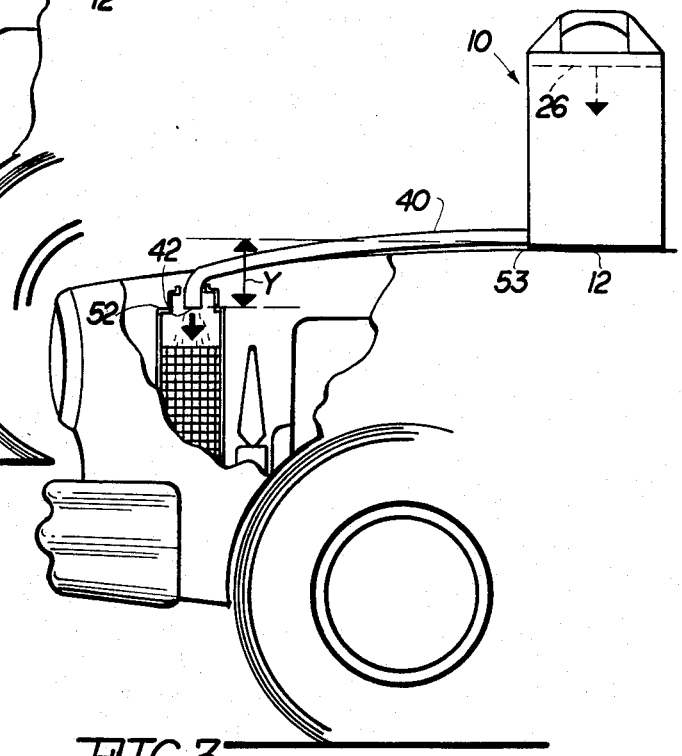
FIG. 3 shows stationary placement of the container during the dispensing operation.
Figure 6:
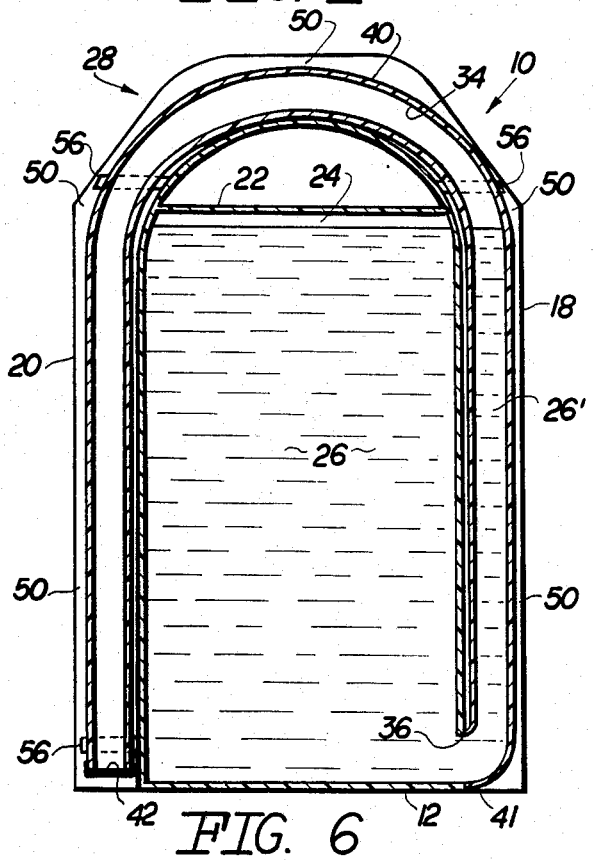
FIG. 6 is a sectional view along line 6—6 of FIG. 1.

The present invention also comprises a dispensing means for removing the liquid product 26 from the interior 24 of container 10 and delivering it to a specific location as shown in FIGS. 2 and 3, to be described in greater detail hereinafter. The dispensing means comprises an access aperture 36 disposed in fluid communication with the hollow interior 24 and any liquid or like material 26 contained therein. The access aperture 36 is disposed adjacent to base means 12 at the lower end or extremity of the container as shown in FIG. 6. The dispensing means further includes a spout structure in the form of an elongated hollow conduit 40 formed from a flexible material and having one end as at 41 fixedly or integrally connected in fluid communicating relation to the access aperture 36 and accordingly any liquid 26 contained in the interior 24 of the container 10. The opposite end of conduit 40 as at 42 has an open ended structure for dispensing or delivery of liquid 26' from the conduit 40 to a specific location (see FIGS. 2 and 3). Open end 42 may be capped or temporarily closed by a stopper or cap structure 43 to prevent leakage of the liquid 26' from the conduit 40.

Figure 4:
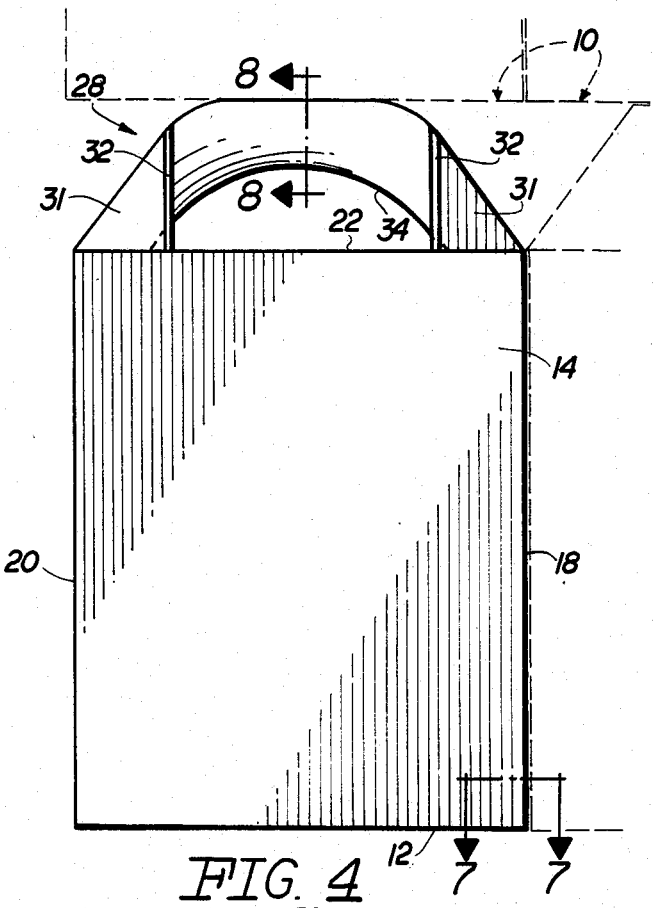
FIG. 4 is a front plan view of the container shown in solid lines and a plurality of like containers represented in broken lines disposed in immediately adjacent relation thereto.
Figure 5:
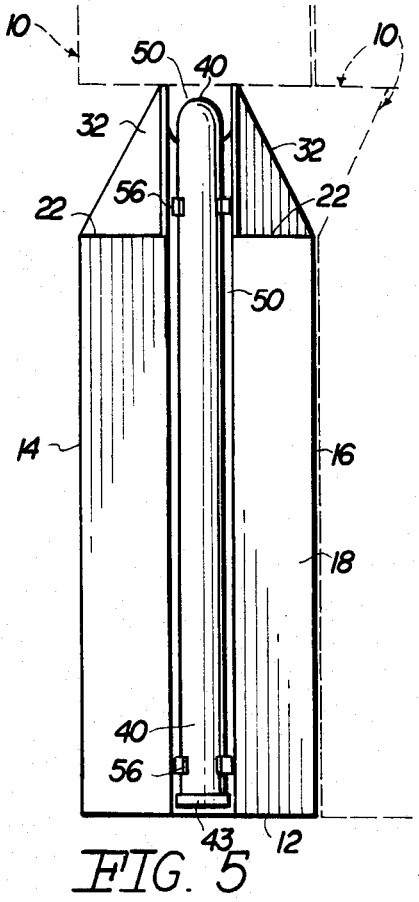
FIG. 5 is an end view along line 5—5 of FIG. 1 with similar containers shown in immediately adjacent relation thereto represented in broken lines.
Figure 7:
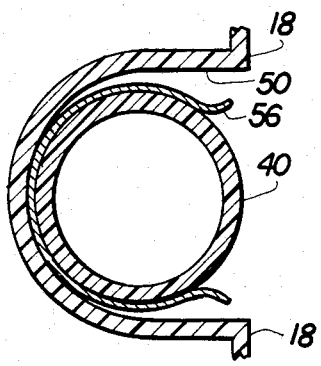
FIG. 7 is a sectional view along line 7—7 of FIG. 4 showing details of dispensing and storage structure associated with the container of the present invention.
Figure 8:
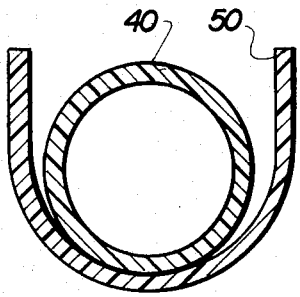
FIG. 8 is a sectional view of a gripping handle structure along line 8—8 of FIG. 4 of the present invention.

An important structural feature of the present invention comprises the existence of storage means for placement of the elongated conduit 40 in an out-of-the-way, non-protruding location relative to the outer or exposed surface of the container 10. The storage means comprises an elongated storage channel 50 extending from a lower extremity of the container 10 immediately adjacent base 12 and access aperture 36 and upwardly along the length of the side wall 18. The storage channel 50 extends continuously along the length of the handle means 28 and is integrally formed to extend along the gripping portion 30 immediately above the space 34 provided for the hand of a carrier as shown in FIG. 2. As shown in FIG. 5, the storage channel 50 extends downwardly from the handle means 28 along the length of the opposite side wall 18 to the base 12 at an opposite peripheral edge relative to the beginning of the storage channel 50 immediately adjacent access aperture 36. It should be emphasized that the structure, configuration and dimension of the storage channel 50 is such as to extend continuously about the periphery of the container so as to include an overall longitudinal dimension sufficient to allow the provision of an elongated conduit 40 of similar longitudinal dimension. As shown in FIGS. 2 and 3 and as will be explained in greater detail hereinafter, the longitudinal dimension of the conduit 40 is such as to allow positioning or placement of the container 10 in any of a number of locations while specifically delivering or directing the contained liquid material 26 into a specific location such as within the entrance of an automobile radiator structure 52. As shown in FIGS. 5, 7 and 8, the transverse dimension or depth of the storage channel 50 is at least equal to the diameter of conduit 40 so as to allow placement of the conduit 40 within the storage channel 50 in a totally recessed relation. The conduit 40 does not protrude from the outer surface of the container and thereby allows side-by-side stacking or placement of similar containers 10' as shown in FIGS. 4 and 5 in broken lines. With reference to FIG. 7, connecting means are provided for removably retaining the conduit 40 within and along the length of the storage channel 50. Such connecting means includes a plurality of connecting elements 56 which, in a preferred embodiment, comprises a one-piece resilient spring-like element having an open portion dimensioned to allow the conduit 40 to pass therethrough and be retained therein due to the inherent flexibility of each of the connecting elements 56.

With reference to FIGS. 2 and 3, the structure of the container 10 is such as to allow delivery of liquid material 26 from the interior of the container to a specific location such as within radiator structure 52 of a conventional automobile or the like. Such is accomplished by removing conduit 40 from its stored position along the length of storage channel 50 and placing open end 42 into the entrance of radiator 52. While such placement is being accomplished, the container 10 (FIG. 2) is positioned such that the liquid material 26 maintained within the container 20 is below the entrance level of the radiator 52 (see directional arrow X). Once the open end 42 of conduit 40 is so positioned, the container 10 may thereby be positioned on any supporting surface 53 such that the base 12 of container 10 is maintained above the position of entry of end 42 of conduit 40 as represented by directional arrow Y in FIG. 3. When so positioned, gravity will force flow of the liquid material 26 from the container into the radiator 52. Naturally, only a portion of the liquid material 26 can be delivered to a radiator 52 or other location rather than the entire amount. It should be emphasized that the length of the conduit 40 as well as the substantially equal length of the storage means 50 is such as to allow variable placement of the container 10 in any of a number of locations thereby alleviating the necessity to constantly handle, tilt or angularly orient the container 10 in order to insure proper liquid flow of the material 26 from the interior of the container 10 into a desired location for liquid delivery as at radiator 52. Proper venting means may be included in the container 10 so as to facilitate emptying of the liquid material 26 therefrom.

What is claimed is:

1. A disposable packaging container of the type primarily designed to contain liquid material therein and dispense it therefrom, said container comprising:

(a) base means for supporting the remainder of the container and being structured and configured for supported disposition on a given surface, (b) a front wall and a rear wall disposed in spaced relation to one another and integrally connected to and extending upwardly from said base, (c) two oppositely disposed side walls extending upwardly from said base in spaced apart relation to one another and each disposed and structured for integral, interconnecting relation between said front and said rear walls, (d) a top wall integrally connected to upper peripheral edges of said front wall, rear wall and side walls, and oppositely disposed to said base means, (e) handle means for lifting said container and being integrally secured to said container in spaced, overlying relation to said top wall and configured to define a hand space above said top panel, (f) said base means, front wall, rear wall, opposite side walls and top wall collectively defining a hollow interior for storage of liquid material therein, (g) dispensing means for emptying the liquid material from said hollow interior and comprising an access aperture formed in said container in communicating relation with said hollow interior at a lower extremity thereof adjacent said base means, (h) said dispensing means further comprising a spout structure comprising a flexible hollow conduit of elongated configuration having one end secured in fluid receiving relation to said access aperture and said hollow interior, (i) a storage channel integrally formed in said container and extending continuously along substantially the entire length of both of said opposite side walls and said handle means, said storage channel and said conduit being of substantially equal length and each having a longitudinal dimension equal to the collective length of said opposite side walls and said handle means, (j) said handle means comprising a gripping portion extending upwardly from and in overlying relation to said top wall, a gripping space disposed between said gripping portion and said top wall and having a sufficient dimension to allow passage of a hand therethrough for gripping of said gripping portion, (k) said gripping portion further comprising two opposite disposed ends fixedly secured to said top wall and extending upwardly therefrom, an upper exposed face of each of said ends and said gripping portion structured to define a continuous portion of said storage channel overlying said top wall, (l) said storage channel extending continuously and in uninterrupted configuration about a periphery of said container and between oppositely disposed peripheral portions of said base and extending over said top wall and continuously along said gripping portion, (m) connecting means for detachably retaining said conduit within said storage channel, said connecting means comprising a plurality of connecting elements disposed in spaced relation to one another along the length of said storage channel, said plurality of connecting elements structured for removable retaining engagement of said conduit at spaced apart points along the length thereof, and (n) said upper exposed face of said gripping portion further being substantially horizontally oriented when said packaging container is in a normal upright position thereby to allow a plurality of said containers to be disposed in adjacent, stacked and side-by-side relation to one another without interference with said conduit when in said storage channel.

2. A container as in claim 1 wherein each of said connecting elements are mounted within said storage channel in non-protruding relation to the exposed surface of said container, said connecting elements structured for removable retention of said conduit within said storage channel and cooperatively configured relative to a cross-section of said channel for mounting therein.

3. A container as in claim 1 wherein said front and side walls are spaced from one another a substantially equal distance along their respective length, said distance substantially equal to the transverse dimension of said opposite side walls.

4. A container as in claim 3 wherein said front and side walls have a transverse dimension substantially greater than the transverse dimension of said side walls, wherein said container comprises a substantially flattened overall configuration and is dimensioned and configured to facilitate adjacent, side-by-side packing of a plurality of said containers.

5. A container as in claim 1 formed from a flexible, moldable material and defined by a substantially molded, one-piece construction.

* * * * *